United States Patent [19]

Kawamura et al.

[11] 3,981,642

[45] Sept. 21, 1976

[54] PROTECTIVE DEVICE FOR ROTARY ENGINE OIL SEAL

[75] Inventors: Kazuhiro Kawamura; Kunihiko Mizutani, both of Toyota, Japan

[73] Assignee: Toyota Jidosha Kogyo Kabushiki Kaisha, Japan

[22] Filed: June 10, 1974

[21] Appl. No.: 478,091

[30] Foreign Application Priority Data

July 9, 1973 Japan ..... 48-80535[U]

[52] U.S. Cl. ..... 418/91; 418/142

[51] Int. Cl.[2] ..... F01C 19/08; F01C 21/04

[58] Field of Search ..... 418/91, 142; 123/8.01; 277/58

[56] References Cited

UNITED STATES PATENTS

| | | | |
|---|---|---|---|
| 3,179,331 | 4/1965 | Paschke et al. | 418/142 |
| 3,300,127 | 1/1967 | Yamamoto et al. | 418/142 |
| 3,481,312 | 12/1969 | Bensinger et al. | 418/142 |
| 3,535,061 | 10/1970 | Yamamoto et al. | 418/142 |
| 3,764,240 | 10/1973 | Griffith | 418/142 |

FOREIGN PATENTS OR APPLICATIONS

| | | | |
|---|---|---|---|
| 1,334,159 | 6/1963 | France | 418/142 |
| 1,551,093 | 3/1970 | Germany | 418/142 |
| 1,016,540 | 1/1966 | United Kingdom | 418/142 |

*Primary Examiner*—John J. Vrablik
*Attorney, Agent, or Firm*—Toren, McGeady and Stanger

[57] ABSTRACT

An oil seal protector for rotary engines is provided to prevent deleterious combustion gases from damaging the oil sealing assemblies provided on each side of the engine rotor. The sealing assemblies include an O-ring and the protective device comprises annular grooves which extend completely about the sealing assembly on each side of the rotor and which are located radially outwardly from such sealing assemblies. A seal ring is fitted within each of the annular grooves of the protective device and spring means are provided for urging the ring against the sides of the engine housing.

1 Claim, 3 Drawing Figures

PROTECTIVE DEVICE FOR ROTARY ENGINE OIL SEAL

BACKGROUND OF THE INVENTION

The present invention relates to devices for protecting the oil sealing assemblies used in rotary engines for the purpose of preventing lubricating oil from seeping out of a lubricating oil chamber, located radially inwardly of the rotor on the drive shaft side thereof, into the engine combustion chamber located peripherally about the rotor.

In rotary engines, there is usually provided a side seal on each side of the rotor to prevent combustion gas in the combustion chamber from entering the chamber in which lubricating oil is present. In addition, an oil sealing assembly including an O-ring is also provided radially inwardly of such a side seal on each rotor side to inhibit rotor lubricating oil from flowing into the combustion chamber.

However, there still exists a likelihood that combustion gas may escape through the side seal by leakage occurring between the side seal and the sides of the engine housing. Such leakage would result in exposure of the oil sealing assembly to the combustion gases during eccentric rotation of the engine rotor. Since the combustion gases are of extremely high temperatures, the O-ring in the oil sealing assembly may be badly damaged by exposure to such high temperature heat thereby impairing the sealing performance of the assembly.

Usually, there are provided two or more oil sealing assemblies on each side of the rotor to assure high oil sealing efficiency. In such a case, the radially outermost oil sealing assembly will be most adversely affected since it is closer to the combustion chamber and it is more likely to have its O-ring exposed to the heat of the combustion gas thereby rendering it unable to perform its oil sealing function. Furthermore, since an O-ring is provided in each of the oil sealing assemblies, the overall size of the oil sealing mechanism is necessarily enlarged in width taken radially of the rotor, and there thus arises a space problem when plural units of oil sealing assemblies are to be provided on both sides of the rotor.

The present invention is aimed at providing means for protecting the oil sealing assembly in a simple and expedient manner without requiring enlargement of the overall sealing mechanism to the extent necessary when plural oil seals must be utilized.

SUMMARY OF THE INVENTION

Briefly, the present invention is characterized by an annular seal ring which is provided radially outwardly of each of the oil sealing assemblies on both sides of the rotor thereby to protect each of the sealing assemblies against the heat of combustion of the gas in the combustion chamber.

More specifically, the present invention is adapted for use in a rotary engine having an eccentrically rotatable rotor, a rotor housing including housing sides located on both sides of the rotor closely adjacent thereto, a lubricating section located generally centrally of the rotor and containing therein lubricating oil, a combustion chamber defined within said housing radially outwardly of the lubricating section peripherally of the rotor, and annular oil seals each including an O-ring provided on both sides of the rotor between the rotor and the housing sides to prevent lubricating oil in the lubricating section from escaping radially outwardly of the rotor into the combustion section. The improvement of the present invention is directed to a protective device for the oil seals, which protective device comprises annular grooves defined in the rotor on both sides thereof, said grooves being located radially outwardly of each of said oil seals and extending completely thereabout, sealing rings extending continuously within said grooves, and spring means fitted respectively within said grooves urging said sealing rings against said housing sides in sliding engagement therewith to prevent exposure of the oil seals to deleterious combustion gases from the combustion chamber.

The annular grooves are located to extend concentrically with the oil seals in close proximity thereto and, since the protective device of the present invention is located radially outwardly of the oil seal, arrangement of the oil seal with its O-ring on the radially inner side thereof will operate to enhance the protective characteristics of the invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
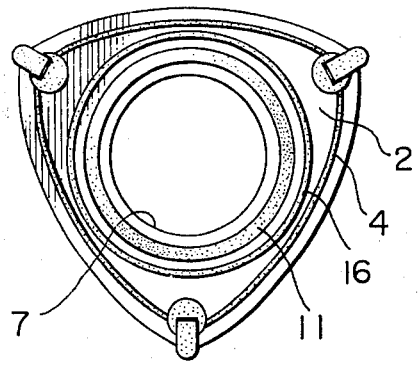
FIG. 1 is a side view of the rotor of a rotary engine provided with an oil seal protecting device according to the present invention.
Figure 2:
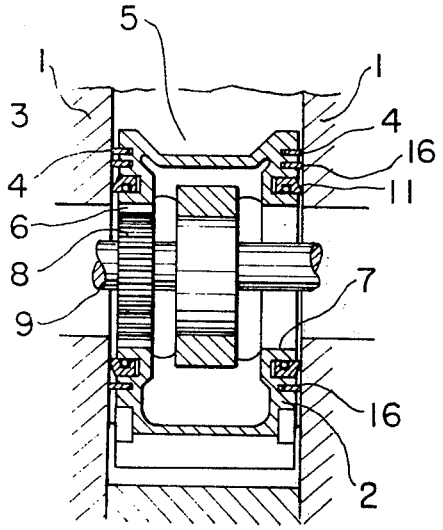
FIG. 2 is a longitudinal sectional view of the principal parts of the rotary engine having the protective device of the present invention incorporated therein.
Figure 3:
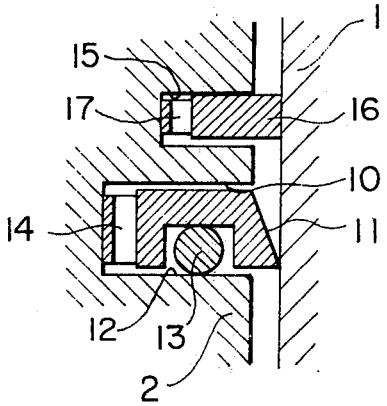
FIG. 3 is an enlarged sectional view of a principal part of the protective mechanism shown in FIG. 2.

Referring now to the drawing, and more particularly to a rotary engine assembly having the present invention utilized therein, an engine rotor 2 is mounted to be eccentrically rotatable in a rotor housing including housing sides 1 on both sides thereof. Side seals 4 are provided in respective grooves formed in the outer peripheral portions of the rotor on both sides thereof. The side seals 4 are arranged to be pressed in sliding engagement against the sliding faces of the housing sides 1 by means of springs (not shown) in order to prevent combustion gas from leaking radially inwardly of the rotor 2 from a combustion chamber 5 defined by the rotor housing between the housing sides 1 peripherally about the rotor 2.

The rotor 2 has an opening 7 provided centrally thereof within which there is located an internal gear 6 arranged in meshing engagement with a gear 8 through which a drive shaft 9 is rotatably driven. In order to lubricate the internal gearing 6 and 8 of the drive shaft 9 and to cool the rotor, lubricating oil is supplied to a lubricating chamber within which these parts are located.

An oil seal ring 11 extending circumferentially completely about the opening 7 on each side of the rotor 2 comprises a lip portion at one end thereof and is fitted to be axially slidable relative to the rotor 2 within an annular groove 10. Each of the oil seal rings 11 comprises a generally U-shaped cross-sectional configuration in order to define a recess 12 into which an O-ring 13 is fitted.

The oil seal assembly is intended to provide an oil tight seal between the oil seal ring 11 and the annular groove 10. A spring 14 is provided within the annular groove 10 in engagement between the bottom of the annular groove and the side of the oil seal ring 11 in order to urge the lip portion of the ring 11 against the sliding face of the corresponding housing side 1.

In addition, each of the sides of the rotor 2 is provided with an annular groove 15 located radially outwardly of the annular groove 10 in close proximity thereto, with a seal ring 16 being fitted in each of the grooves 15 in a manner to be slidable within the groove 15 in directions axially of the rotor 2. Between the bottom of each of the annular grooves 15 and the seal rings 16, there is disposed a spring member 17 adapted to urge the end of the seal ring 16 into sliding engagement against the sliding face of the associated housing side 1. On each side of the rotor 2, the distance between the side seal 4 and the oil seal ring 11 is extremely small and the width of the seal ring 16 is arranged to be smaller than that of the oil seal ring 11. In some applications, plural seal rings may be provided on both sides of the rotor.

The functioning of the oil seal protective device of the present invention is such that when the fuel-air mixture is supplied into the combustion chamber and combustion thereof is effected, the rotor 2 is forced to rotate eccentrically within the rotor housing and the housing sides. As the lip portion of the oil seal ring 11 slides in spring contact with the sliding faces of the housing sides 1, lubricating oil within the lubricating chamber containing the internal gearings 6 and 8 is forced to flow radially outwardly of the rotor 2. Inasmuch as the side seals 4 are pressed into spring-biased engagement with the sliding faces of the housing sides 1, very little combustion gas from within the combustion chamber will flow to the radially inner sides of the rotor 2. However, since the combustion gas is under high pressure, a small portion of gas will leak between the side seals 4 and the housing sides 1 during rotation of the rotor 2 and this leaking gas will flow to the radially inner side of the rotor 2. At this time, however, since the seal rings 16 are also pressed in spring-biased sliding contact with the sliding faces of the housing sides 1, any combustion gas which leaks beyond the side seals 4 is prevented by the seal rings 16 from flowing further inwardly radially of the rotor 2. Thus, such leakage is prevented from flowing toward the oil seal rings 11 and from reaching the rings 11. Therefore, the oil sealing assemblies are maintained free from contact or exposure to the influence of the heat of the combustion gases.

As described above, the oil seal protecting device of the present invention provides annular seal rings located radially outwardly of the respective oil seal rings, and any combustion gas which has leaked through to the radially inner side of the rotor from the side seals is blocked from flowing further by the seal rings of the present invention and from flowing toward the oil seal rings. Accordingly, the O-rings which are provided in each oil sealing assembly are protected against the direct influence of the heat of the combustion gases. It is thus possible to prevent or minimize damage to the O-rings by exposure to heat or by chemical deterioration thereof which might be caused by the combustion gas.

Furthermore, since no O-ring need be provided in the protective device of the present invention it will be seen that the radial width of the protecting device may be relatively small. Such a protective device and its seal ring can be readily adapted in each of the rotor sides and can be manufactured with ease. Even if the seal ring is narrowed in its radial width, no problems arise with regard to its function preventing combustion gas from flowing toward the oil sealing ring. Thus, the oil sealing assemblies will be protected in a manner which is simple and expedient and which does not require undue enlargement of the overall assembly.

While a specific embodiment of the invention has been shown and described in detail to illustrate the application of the inventive principles, it will be understood that the invention may be embodied otherwise without departing from such principles.

What is claimed is:

1. A rotary engine comprising, in combination: an eccentrically rotatable rotor; a rotor housing including housing sides located on both sides of said rotor closely adjacent thereto; a lubricating section located generally centrally of said rotor and adapted to have lubricating oil contained therein; a combustion chamber defined within said housing radially outwardly of said lubricating section peripherally of said rotor; annular oil seals each including an O-ring provided on both sides of said rotor between said rotor and said housing sides to prevent lubricating oil in said lubricating section from escaping radially outwardly of said rotor into said combustion section; and a protective device for said oil seals located radially outwardly of said oil seals and extending completely thereabout on both sides of said rotor, said protective device comprising: annular grooves defined in said rotor on both sides thereof; said grooves being located radially outwardly of each of said oil seals and extending completely thereabout concentrically with said oil seals in close proximity thereto; sealing rings extending continuously within said grooves; spring means fitted respectively within each of said grooves urging said sealing rings against said housing sides in sliding engagement therewith to prevent exposure of said oil seals to combustion gases escaping from said combustion chamber, said oil seals including an oil sealing ring extending continuously within oil seal grooves provided on both sides of said rotor, said oil sealing rings each defining a circumferentially extending U-shaped cavity therein opening radially inwardly of said rotor and facing away from said annular grooves of said protective device, said cavity having O-rings located therein; and gas sealing means provided on both sides of said rotor between said rotor and said housing sides to prevent combustion gases from said combustion chamber from escaping radially inwardly of said rotor and from coming into contact with said annular oil means, said gas sealing means being located radially outwardly of said protective device and extending to surround said protective device and said annular oil seals in an arrangement having said protective device radially juxtaposed between said gas sealing means and said annular oil seals; said housing sides comprising a generally flat planar configuration with each of said sealing rings of said protective device comprising a flat planar abutment face extending generally parallel to said housing sides and urged by said spring means into abutting relationship therewith across substantially the entire area of said face of said sealing rings.

* * * * *